US006662385B1

(12) United States Patent
Bayne

(10) Patent No.: US 6,662,385 B1
(45) Date of Patent: Dec. 16, 2003

(54) SHOWER DOOR TRACK CUSHION

(76) Inventor: Anthony J. Bayne, 302 W. Fifth St. #208, San Pedro, CA (US) 90731

( * ) Notice: Subject to any disclaimer, the term of this patent is extended or adjusted under 35 U.S.C. 154(b) by 0 days.

(21) Appl. No.: 10/127,644

(22) Filed: Apr. 22, 2002

(51) Int. Cl.[7] ..... A47K 3/08

(52) U.S. Cl. ..... 4/557; 4/577.1; 4/580; 4/581

(58) Field of Search ..... 4/557, 577.1, 579, 4/580, 581, 582, 655, 621; 248/345.1

(56) References Cited

U.S. PATENT DOCUMENTS 1,805,622 A * 5/1931 Goodwin ..... 4/579
2,374,490 A * 4/1945 Lehman ..... 4/557
5,771,506 A * 6/1998 Joiner ..... 4/575.1
6,044,601 A * 4/2000 Chmela et al. ..... 52/287.1
6,115,857 A * 9/2000 Bidegain ..... 4/574.1
6,378,831 B1 * 4/2002 Copeland, Jr. ..... 248/345.1

* cited by examiner

*Primary Examiner*—Gregory L. Huson
*Assistant Examiner*—Azy Kokabi
(74) *Attorney, Agent, or Firm*—Lee W. Tower

(57) ABSTRACT

A shower door track cushion is provided, which includes a material having a length. A slit is cut longitudinally along the length of the bottom of the material. The slit is adapted to fit over a shower door track and retain the material on the shower door track, which is located along a top edge of a bathtub. The material includes an extending rectangular section integral to the material at one end of the length of the material, which is adapted to fit between a first and a second shower door vertical support in order to retain the material between the first and second shower door vertical supports. The material can be made of polyethylene foam and can include a rounded top.

10 Claims, 7 Drawing Sheets

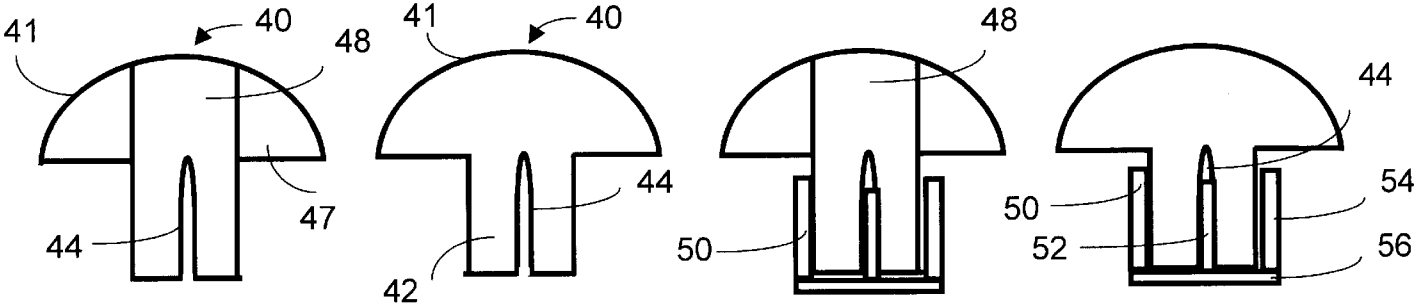
FIG. 5A
FIG. 5B
FIG. 6A
FIG. 6B
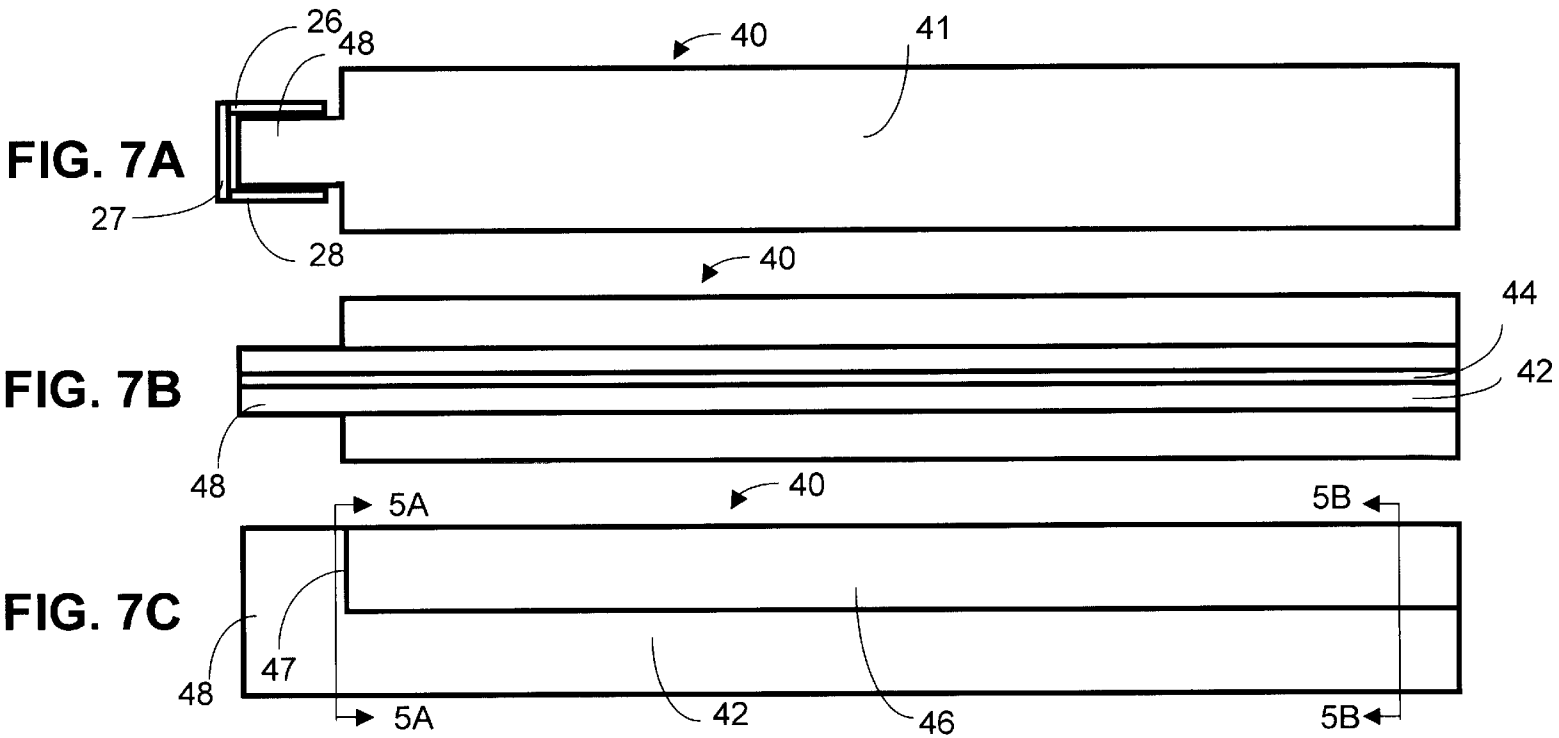
FIG. 7A
FIG. 7B
FIG. 7C

SHOWER DOOR TRACK CUSHION

BACKGROUND OF THE INVENTION

1. Field of the Invention

This invention relates generally to cushions and more particularly to a cushion for use with a bathtub having sliding shower doors.

2. Description of the Related Art

There are many bathtubs that are equipped with sliding shower doors that permit a bathtub to be used as a shower as well as a bathtub. The shower doors are mounted on the bathtub on shower door tracks that allow one of the shower doors to be slid open. Often it is necessary to use the bathtub to bathe an infant or an elderly person that may be ill or disabled. In this case one of the shower doors is slid open to allow a caregiver, such as a mother, to bathe an infant in the bathtub. While bathing the infant it is necessary for the caregiver to rest his/her forearms on the edge of the bathtub; however, for a bathtub equipped with sliding shower doors this can be an inconvenient and uncomfortable situation. The reason for this is that the forearms of the caregiver must rest directly on the shower door tracks. The shower doors slide along these tracks, which are mounted directly on the top edge of the bathtub. The shower door tracks generally have a vertically extending edge. This edge while not sharp is very uncomfortable to rest forearms upon, especially when bearing any weight, such as the weight of an infant.

To alleviate this discomfort caregivers currently place an object such as a towel along the edge of the bathtub. This provides some relief but it is difficult to keep the towel in position while at the same time bathing an infant or elderly ill or disabled adult. Further, inevitably the towels soak up water from the bathing, which creates more laundry, and thus more work for the caregiver.

Another problem with shower door tracks is that they present a safety issue. There is a chance that a person's toe or toes can get caught in between the tracks when entering or exiting the bathtub. This happens on rare occasions and can cause a person to trip and possibly break bones, which is especially perilous for elderly persons. Also a person can lose a toenail in such an accident.

What is needed is a waterproof or water-resistant cushion that will stay in place and provide comfort and safety even if there are shower door tracks along the edge of a bathtub.

BRIEF DESCRIPTION OF THE DRAWINGS

The objects and many of the attendant features of this invention will be more readily appreciated as the same becomes better understood by reference to the following detailed descriptions and considered in connection with the accompanying drawings in which like reference symbols designate like parts throughout the figures.

FIG. 5A is an elevational sectional view of a shower door track cushion along line 5A—5A of FIG. 7C in accordance with the present invention.

FIG. 5B is an elevational sectional view of a shower door track cushion along line 5B—5B of FIG. 7C in accordance with the present invention.

FIG. 6A shows the elevational sectional view of the shower door track cushion of FIG. 5A retained upon a shower door track in accordance with the present invention.

FIG. 6B shows the elevational sectional view of the shower door track cushion of FIG. 5B retained upon a shower door track in accordance with the present invention.

FIG. 7A is a top view of a shower door track cushion showing an extending rectangular section retained between a first and a second shower door vertical support in accordance with the present invention.

FIG. 7B is a bottom view of the shower door track cushion of FIG. 7A in accordance with the present invention.

FIG. 7C is a side view of the shower door track cushion of FIG. 7A in accordance with the present invention.

DETAILED DESCRIPTION

Figures 1A, 1B, 2A, 2B, 3A, 3B, 3C:
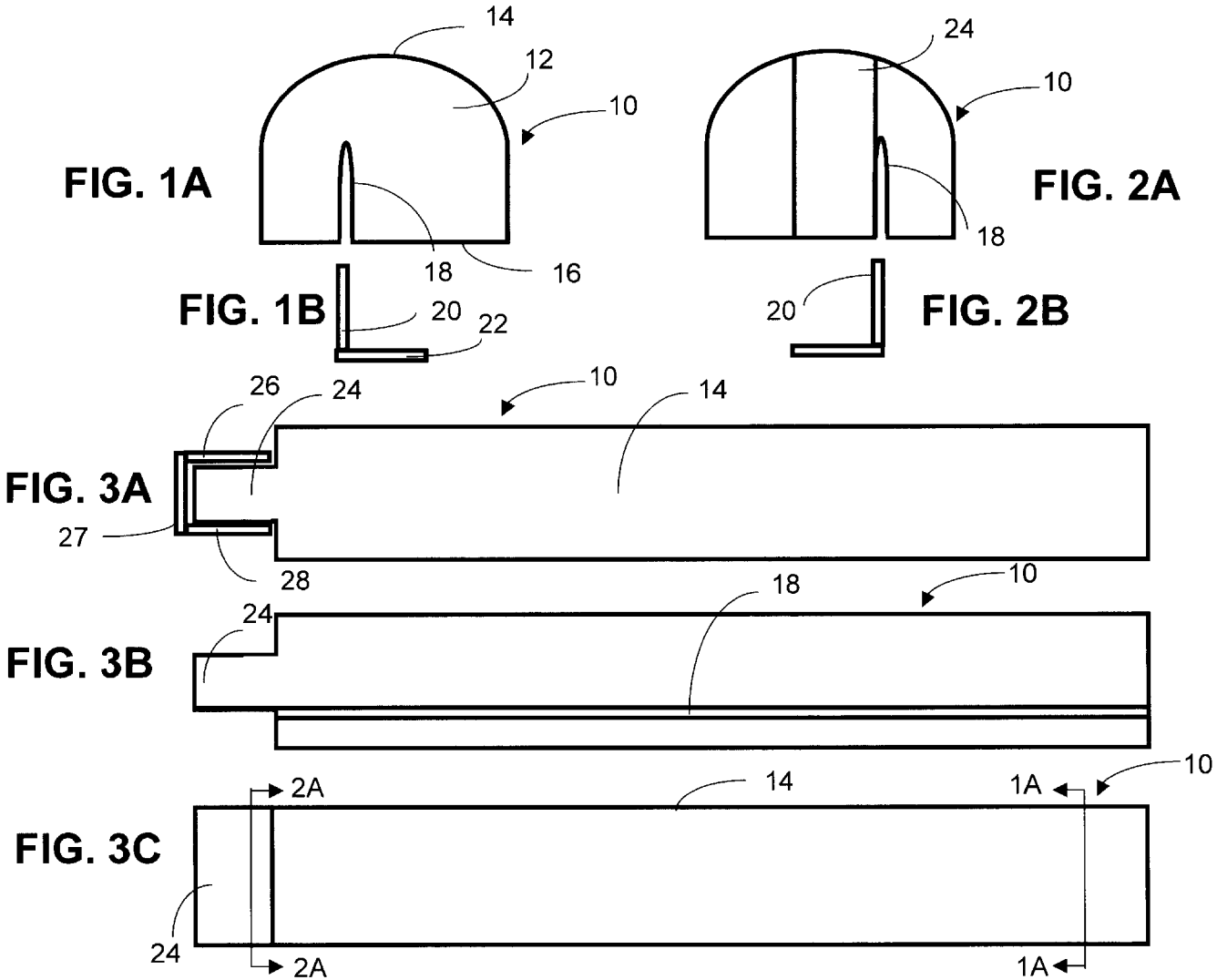
FIG. 1A is an elevational sectional view of a shower door track cushion along line 1A—1A of FIG. 3C in accordance with the present invention.
FIG. 1B is an elevational sectional view of a shower door track upon which the shower door track cushion of FIG. 1A can be retained in accordance with the present invention.
FIG. 2A is an elevational sectional view of a shower door track cushion along line 2A—2A of FIG. 3C in accordance with the present invention.
FIG. 2B is an elevational sectional view of a shower door track upon which the shower door track cushion of FIG. 2A can be retained in accordance with the present invention.
FIG. 3A is a top view of a shower door track cushion showing an extending rectangular section retained between a first and a second shower door vertical support in accordance with the present invention.
FIG. 3B is a bottom view of the shower door track cushion of FIG. 3A in accordance with the present invention.
FIG. 3C is a side view of the shower door track cushion of FIG. 3A in accordance with the present invention.
Figure 4:
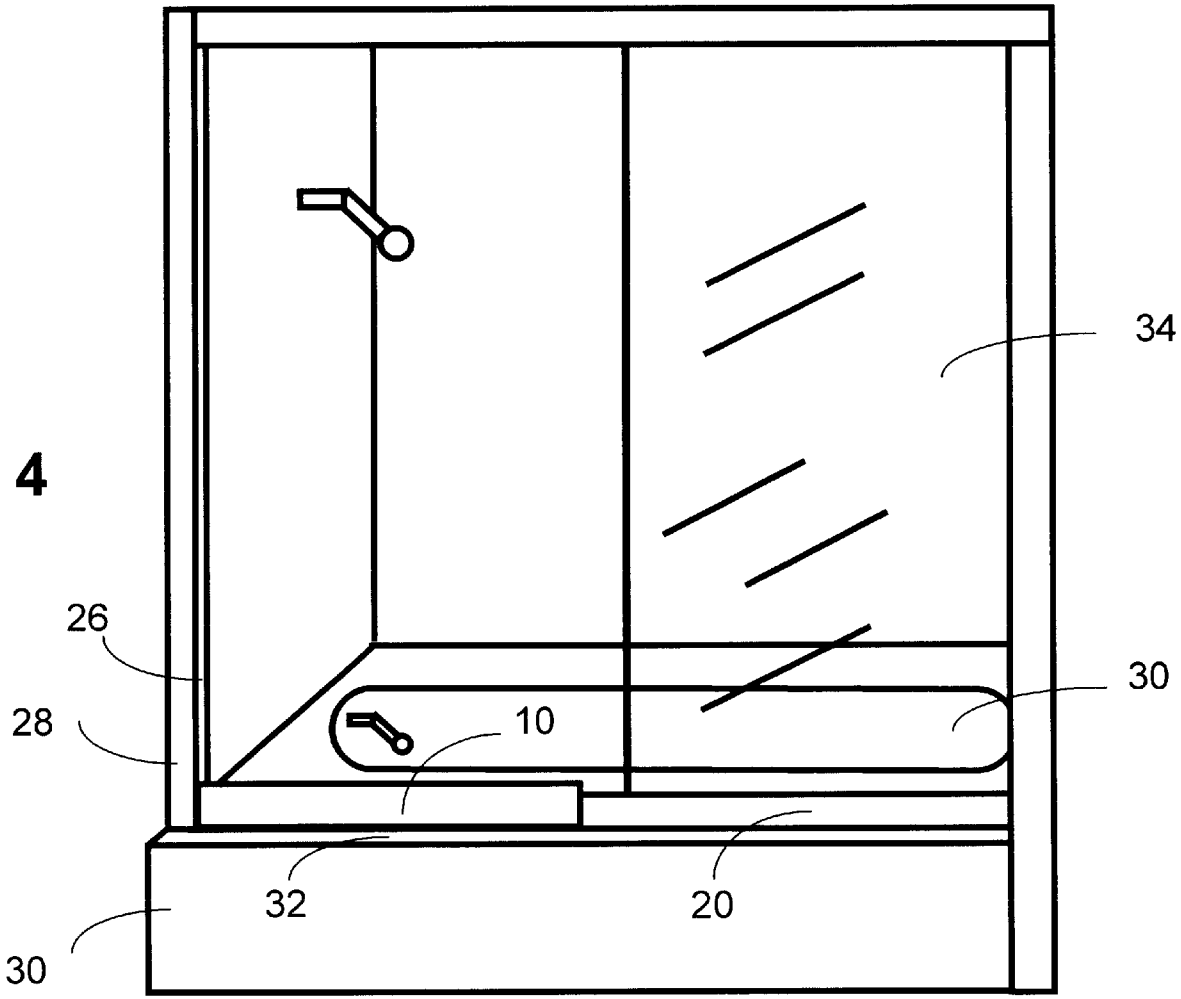
FIG. 4 shows a shower door system mounted on a bathtub, a shower door track, shower door vertical supports, and a shower door track cushion retained by the shower door track and shower door vertical supports in accordance with the present invention.

Referring now to the drawings and more particularly, to FIG. 1, there is shown an elevational sectional view of a shower door track cushion 10, which is a section along line 1A—1A of FIG. 3C. The shower door track cushion can have a rounded top to increase the comfort factor for forearms rested on the cushion while bathing an infant or ill and/or disabled elderly person. The shower door track cushion can be made of a number of materials including polyethylene foam. Polyethylene foam, which is also the material used for water toys and floats, such as noodles, has the advantage of being waterproof. A slit 18 is cut into the foam in the position on shower door track cushion 10 that aligns with the shower door track 20 shown in FIG. 1B. The shower door track 20 is mounted on rail 22, which is along the top edge 32 of a bathtub 30, as shown in FIG. 4. The purpose of the shower door track 20 is to guide a shower door, such as shower door 34 of FIG. 4, so that the shower door can be slid open and closed. As shown in FIG. 1B, the shower door track 20 has a relatively narrow edge, which would be uncomfortable to rest a fourarm upon. By placing the slit 18 in the shower door track cushion over the shower door track 20, the shower door track cushion is held on the shower door track 22 and provides a comfortable resting place for the forearm of a person outside the bathtub who is giving a bath to an infant or ill person sitting inside the bathtub. FIG. 1A shows that the bottom 16 of the shower door track cushion can be relatively flat or whatever contour best fits the top edge of the bathtub.

An extending rectangular section 24 is integral to the material at one end of the length of the shower door track cushion as shown in FIG. 2A, which is an elevational sectional view of the shower door track cushion 10 along line 2A—2A of FIG. 3C. The purpose of this extending rectangular section 24, as also shown in FIGS. 3A through 3C, is to fit between the first and second shower door vertical supports 26 and 28 in order to further retain the shower door track cushion on the top edge 32 of the bathtub 30. The vertical supports 26 and 28 are shown in FIG. 4. FIG. 3A is a top view of shower door track cushion 10 showing the extending rectangular section 24 retained between the first and second shower door vertical supports 26 and 28. FIG. 3B is a bottom view of the shower door track cushion 10 showing the slit 18 and FIG. 3C is a side view of the shower door track cushion of FIG. 3A.

There are different configurations of shower door tracks. In the configuration shown in FIG. 1A there is one vertical shower door track 20. FIG. 5A is an elevational sectional view of a shower door track cushion 40 along line 5A—5A of FIG. 7C, which is designed for a shower door track configuration with three tracks 50, 52, and 54. FIG. 6A shows the elevational sectional view of the shower door track cushion 40 of FIG. 5A retained upon the shower door tracks 50, 52, and 54. FIG. 5B is an elevational sectional view of the shower door track cushion 40 along line 5B—5B of FIG. 7C and FIG. 6B shows the elevational sectional view of the shower door track cushion of FIG. 5B retained upon shower door tracks 50, 52 and 54. The shower door track cushion 40 can have a rounded top 41 and has a downward protruding rectangular section 42 that is adapted to fit between tracks 50 and 54. The slit 44 which is approximately in the middle of the downward protruding rectangular section 42 is designed to fit over track 52 in order to further retain the shower door track cushion 40 on the top edge 32 of the bathtub 30. The shower door track cushion 40 can be made of polyethylene foam or other materials.

An extending rectangular section 48 is integral to the material at one end of the length of the shower door track cushion 40 as shown in FIG. 5A, and FIGS. 7A, 7B, and 7C. The extending rectangular section 48 fits between the first and second shower door vertical supports 26 and 28 and further retains the shower door track cushion on the top edge 32 of the bathtub 30. FIG. 7A is a top view of the shower door track cushion 40 and shows the extending rectangular section 24 retained between the first and second shower door vertical supports 26 and 28. FIG. 7B is a bottom view of the shower door track cushion 40 showing the slit 44. FIGS. 7B and 7C show the downward protruding rectangular section 42. The rounded section 41 of shower door track cushion 40 is ended at 47 in order not to interfere with the mating of the extending rectangular section 48 with the vertical supports 26 and 28.

Figure 9:
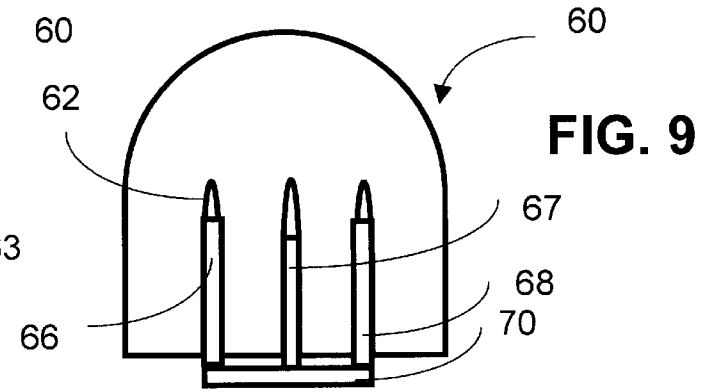
FIG. 9 shows the elevational sectional view of the shower door track cushion of FIG. 8 retained upon a shower door track in accordance with the present invention.
Figure 8:
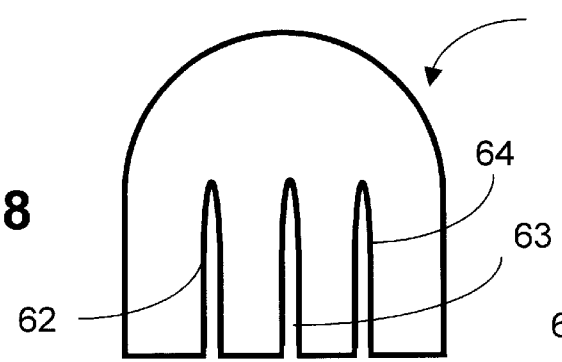
FIG. 8 is an elevational sectional view of a shower door track cushion along line 8—8 of FIG. 10B in accordance with the present invention.
Figure 10A:
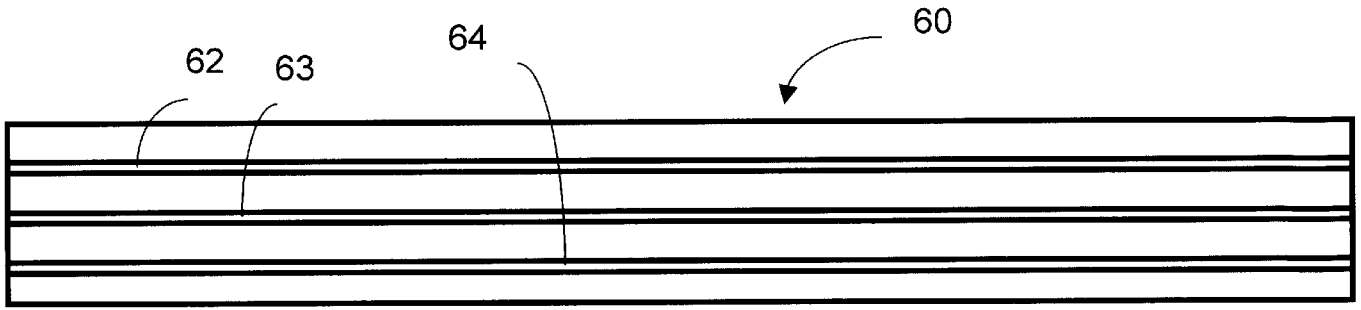
FIG. 10A is a bottom view of a shower door track cushion in accordance with the present invention.
Figure 10B:
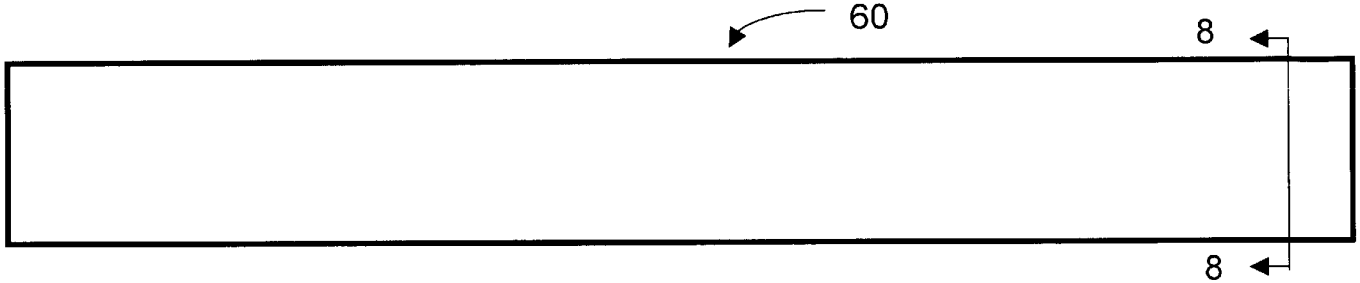
FIG. 10B is a side view of the shower door track cushion of FIG. 10A in accordance with the present invention.

Another design that is readily adaptable to a shower door track configuration with three tracks 66, 67, and 68 is shown in FIGS. 8 and 9. FIG. 8 is an elevational sectional view of a shower door track cushion 60 along line 8—8 of FIG. 10B. FIG. 9 shows the elevational sectional view of the shower door track cushion 60 of FIG. 8 retained upon the shower door tracks 66, 67, and 68. As shown in FIG. 8, the shower door track cushion 60 has three slits 62, 63, and 64, which fit over the tracks 66, 67, and 68, as shown in FIG. 10A is a bottom view of a shower door track cushion 60 showing the three slits and FIG. 10B is a side view of the shower door track cushion of FIG. 10A. The shower door track cushion 60 can be made of polyethylene foam or other materials.

Figure 12:
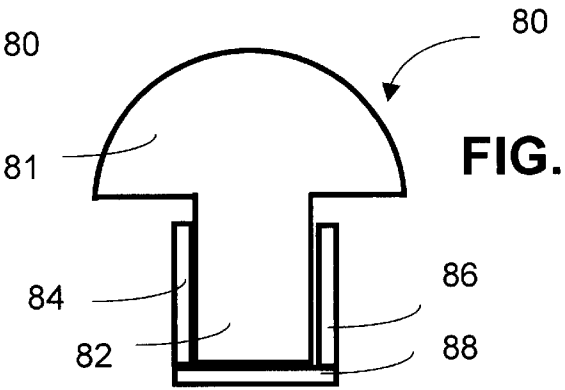
FIG. 12 shows the elevational sectional view of the shower door track cushion of FIG. 11 retained upon a shower door track in accordance with the present invention.
Figure 11:
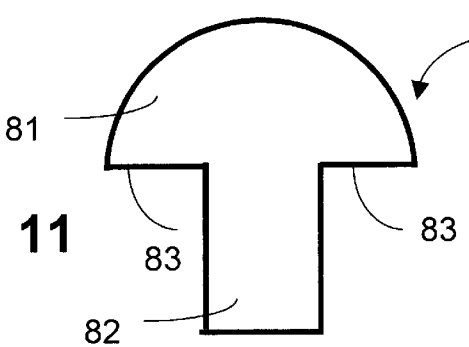
FIG. 11 is an elevational sectional view of a shower door track cushion along line 11—11 of FIG. 13B in accordance with the present invention.
Figure 13A:
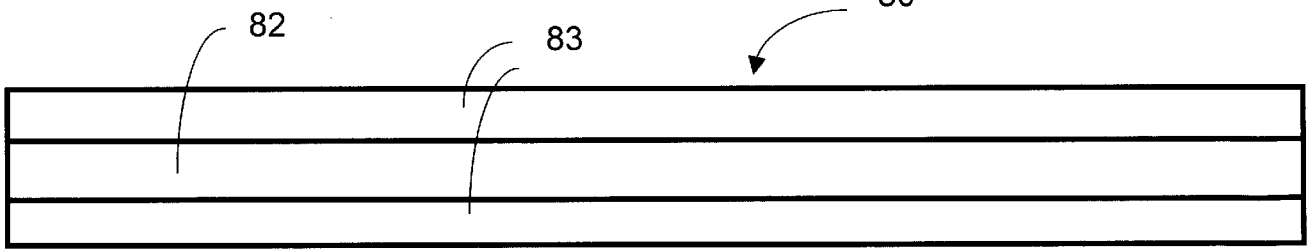
FIG. 13A is a bottom view of a shower door track cushion in accordance with the present invention.
Figure 13B:
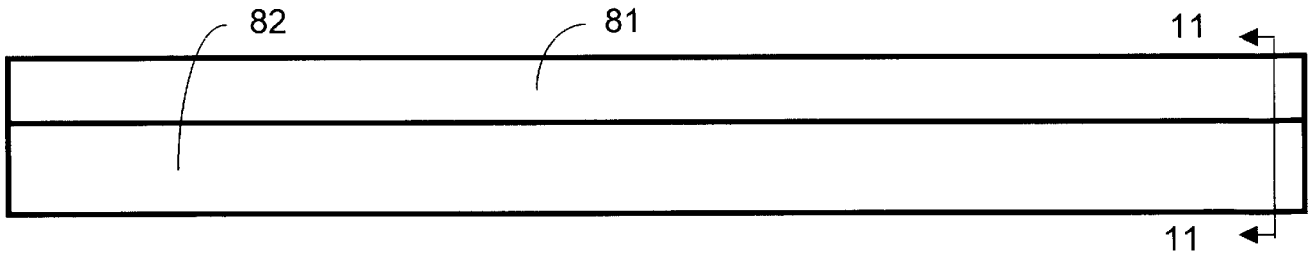
FIG. 13B is a side view of the shower door track cushion of FIG. 13A in accordance with the present invention.

For a shower door track configuration with two tracks, such as tracks 84 and 86 shown in FIG. 12, the shower door track cushion 80 as shown in FIG. 11 can be used. FIG. 11 is an elevational sectional view of shower door track cushion 80 along line 11—11 of FIG. 13B. FIG. 12 shows the elevational sectional view of the shower door track cushion 80 retained between the shower door tracks 84 and 86. FIG. 13A is a bottom view of a shower door track cushion and FIG. 13B is a side view of the shower door track cushion 80, which has a rounded top 81 and a downward extending rectangular section 82. The rounded top 81 can be of various shapes and the downward extending rectangular section 82 can also be of various shapes. The shower door track cushion 80 can be made of polyethylene foam or other materials.

Figure 15:
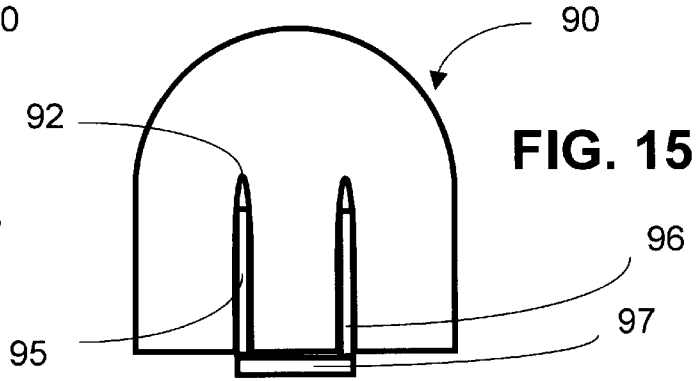
FIG. 15 shows the elevational sectional view of the shower door track cushion of FIG. 14 retained upon a shower door track in accordance with the present invention.
Figure 14:
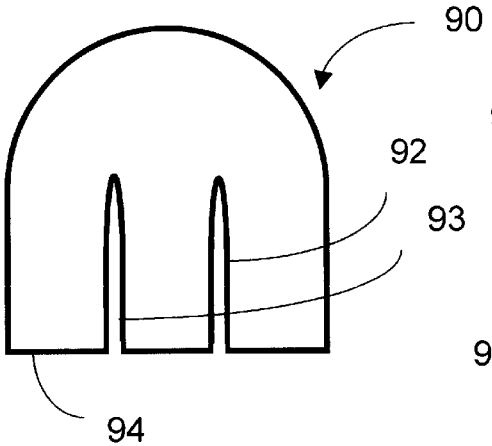
FIG. 14 is an elevational sectional view of a shower door track cushion along line 14—14 of FIG. 16B in accordance with the present invention.
Figure 16A:
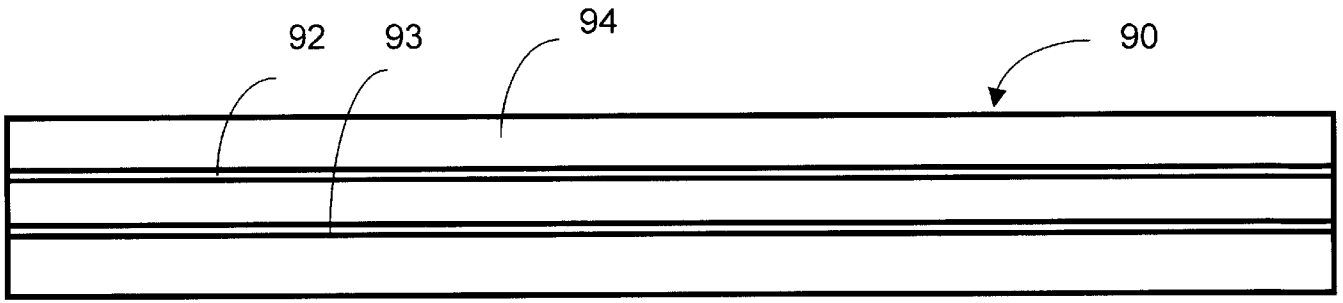
FIG. 16A is a bottom view of a shower door track cushion in accordance with the present invention.
Figure 16B:
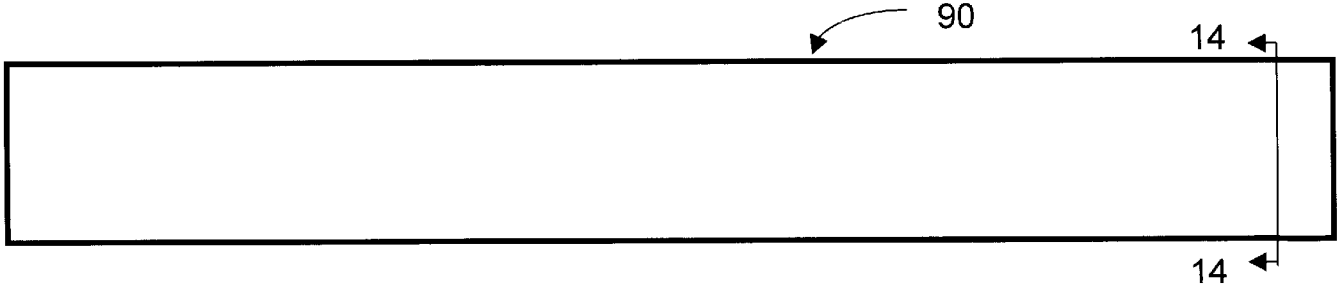
FIG. 16B is a side view of the shower door track cushion of FIG. 16A in accordance with the present invention.

Another design that is readily adaptable to a shower door track configuration with two tracks 95 and 96, is shown in FIGS. 14 and 15. FIG. 14 is an elevational sectional view of a shower door track cushion 90 along line 14—14 of FIG. 16B. FIG. 15 shows the elevational sectional view of the shower door track cushion 90 of FIG. 14 retained upon the shower door tracks 95 and 96. As shown in FIG. 14, the shower door track cushion 90 has two slits 92 and 93, which fit over the tracks 95 and 96, as shown in FIG. 15. FIG. 16A is a bottom view of the shower door track cushion 90 showing the two slits and FIG. 16B is a side view of the shower door track cushion 90. The shower door track cushion 90 can be made of polyethylene foam or other materials.

Figure 18:
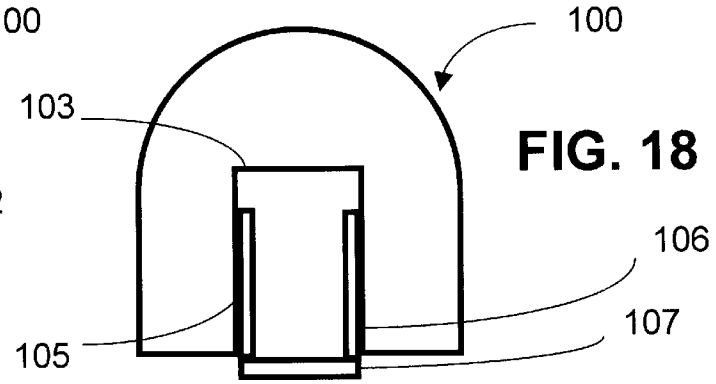
FIG. 18 shows the elevational sectional view of the shower door track cushion of FIG. 17 retained upon a shower door track in accordance with the present invention.
Figure 17:
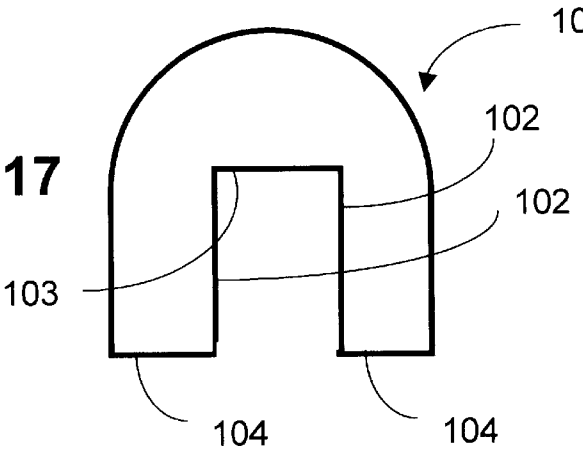
FIG. 17 is an elevational sectional view of a shower door track cushion along line 17—17 of FIG. 19B in accordance with the present invention.
Figure 19A:
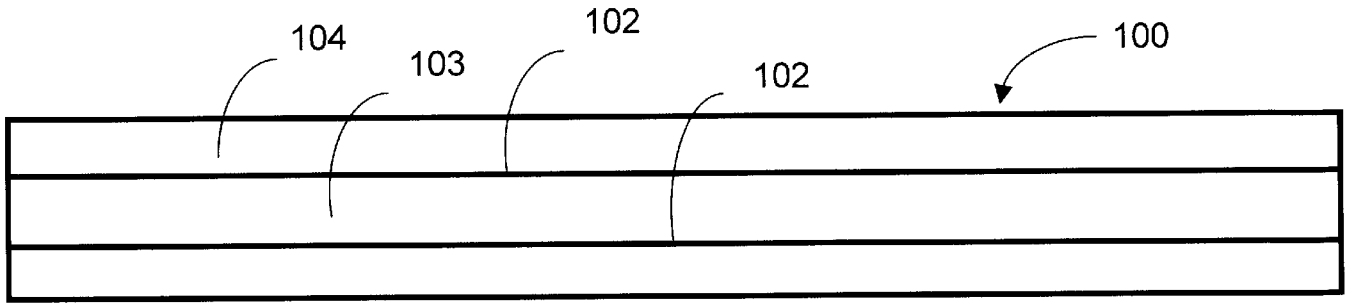
FIG. 19A is a bottom view of a shower door track cushion in accordance with the present invention.
Figure 19B:
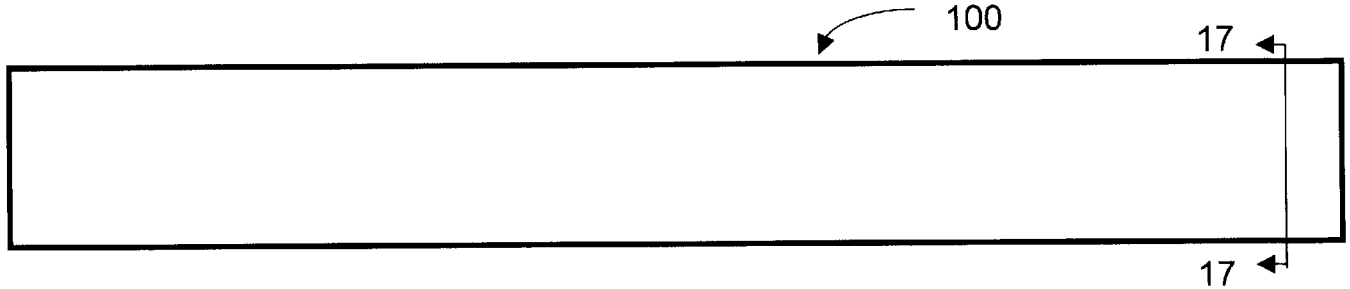
FIG. 19B is a side view of the shower door track cushion of FIG. 19A in accordance with the present invention.

Another cushion design that is readily adaptable to a shower door track configuration with multiple tracks, is shown in FIGS. 17 and 18. FIG. 17 is an elevational sectional view of a shower door track cushion 100 along line 17—17 of FIG. 19B. FIG. 18 shows the elevational sectional view of the shower door track cushion 100 of FIG. 17 retained upon the shower door tracks 105 and 106. As shown in FIG. 17, the shower door track cushion 100 has a slot defined by sides 102 and side 103 that fits over the tracks 105 and 106, as shown in FIG. 18. The cushion 100 is readily adaptable to shower door track configurations with two or three tracks. In the case of three tracks the slot in the cushion is adapted to fit over the two outside tracks. FIG. 17 shows that the bottom 104 of the shower door track cushion can be relatively flat or whatever contour best fits the top edge of the bathtub. FIG. 19A is a bottom view of the shower door track cushion 100 showing the slot defined by sides 102 and 103 and FIG. 19B is a side view of the shower door track cushion 100. The shower door track cushion 100 can be made of polyethylene foam or other materials.

The shower door track cushion has an additional benefit of providing a safety feature. The cushion can be mounted on the shower door tracks on the edge of the bathtub while assisting an elderly infirm adult into or out of the bathtub. The cushion will decrease the chance that a person's toe or toes get caught in between the tracks. This happens on rare occasions and can cause a person to trip and possibly break bones, which is especially perilous for elderly persons. Also a person can lose a toenail in such an accident.

Thus, the shower door track cushion provides a waterproof cushion that will stay in place and provide comfort and safety even if there are shower door tracks along the edge of a bathtub.

The described embodiments of the invention are only considered to be preferred and illustrative of the inventive concept, the scope of the invention is not to be restricted to such embodiments. Various and numerous other arrangements may be devised by one skilled in the art without departing from the spirit and scope of this invention.

It is therefore intended by the appended claims to cover any and all such applications, modifications and embodiments within the scope of the present invention.

What is claimed is:

1. A shower door track cushion comprising:

a material having a length;

a slit cut longitudinally along the length of a bottom of the material, the slit adapted to fit over a shower door track to retain the material on the shower door track; and an extending rectangular section integral to the material at one end of the length of the material, the extending rectangular section adapted to fit between a first and a second shower door vertical support and to retain the material between the first and second shower door vertical supports.

2. The shower door track cushion of claim 1 wherein:

the material comprises polyethylene foam.

3. The shower door track cushion of claim 1 wherein:

the material comprises a rounded top.

4. A shower door track cushion comprising:

a material having a length and having a downward protruding rectangular section along the length, the downward protruding rectangular section integral to the material; and the downward protruding rectangular section adapted to fit between a first and a second shower door track and to retain the material between the first and the second shower door tracks;

wherein the first and second shower door tracks are located along an edge of a bathtub.

5. The shower door track cushion of claim 4 wherein:

the material comprises polyethylene foam.

6. The shower door track cushion of claim 4 wherein:

the material comprises a rounded top.

7. The shower track cushion of claim 4 comprising:

a first slit cut longitudinally along the length of a bottom of the downward protruding rectangular section, the first slit adapted to fit over a third shower door track and to retain the material on the third shower door track; and wherein the third shower door track is located along the edge of the bathtub and between the first and second shower door track.

8. The shower door track cushion of claim 7 wherein:

the material comprises an extending rectangular section integral to the material at one end of the length of the material, the extending rectangular section adapted to fit between a first and a second shower door vertical support and to retain the material between the first and second shower door vertical supports.

9. The shower door track cushion of claim 7 wherein:

the material comprises polyethylene foam.

10. The shower door track cushion of claim 7 wherein:

the material comprises a rounded top.

* * * * *